US007080750B2

(12) United States Patent
Wein et al.

(10) Patent No.: US 7,080,750 B2
(45) Date of Patent: Jul. 25, 2006

(54) PACKING AND WASTE DISPOSAL SYSTEM

(75) Inventors: Abraham Wein, Miami, FL (US); Ralph Velocci, Golden Beach, FL (US)

(73) Assignee: Ruaw, IWC, Miami, FL (US)

( * ) Notice: Subject to any disclaimer, the term of this patent is extended or adjusted under 35 U.S.C. 154(b) by 341 days.

(21) Appl. No.: 10/661,053

(22) Filed: Sep. 12, 2003

(65) Prior Publication Data

US 2005/0056648 A1 Mar. 17, 2005

(51) Int. Cl.
*B65D 90/00* (2006.01)

(52) U.S. Cl. ..... 220/495.01; 220/495.07; 220/495.06

(58) Field of Classification Search ..... 220/495.07, 220/495.08, 495.11; 206/499, 515; 383/37, 383/121, 907, 123
See application file for complete search history.

(56) References Cited

U.S. PATENT DOCUMENTS

| | | | | |
|---|---|---|---|---|
| 3,825,150 | A | 7/1974 | Taylor | |
| 4,366,916 | A | 1/1983 | Guido et al. | |
| 4,418,835 | A | 12/1983 | Watts | |
| 4,498,652 | A | 2/1985 | Malik | |
| 4,938,380 | A | 7/1990 | Donahoe | |
| 5,133,607 | A * | 7/1992 | Bonke | 383/75 |
| 5,178,469 | A * | 1/1993 | Collinson | 383/1 |
| 5,219,220 | A * | 6/1993 | Kucera et al. | 383/120 |
| 5,671,861 | A | 9/1997 | Hall et al. | |
| 6,003,717 | A * | 12/1999 | Long | 220/495.11 |
| 6,019,244 | A * | 2/2000 | Jones | 220/666 |
| 6,102,239 | A * | 8/2000 | Wien | 220/495.07 |
| 6,520,120 | B1 * | 2/2003 | Arnold et al. | 119/850 |
| 6,679,398 | B1 * | 1/2004 | O'Brien | 220/495.02 |

* cited by examiner

*Primary Examiner*—Stephen K. Cronin
*Assistant Examiner*—Eugene Lhymn
(74) *Attorney, Agent, or Firm*—Laurence A. Greenberg; Werner H. Stemer; Ralph E. Locher

(57) ABSTRACT

An improved material packaging system includes a plurality of nested liners removably attached to each other to form a unitary liner structure and a receptacle having a circumferential attachment lip for detachably securing said unitary liner structure to said receptacle. The unitary liner structure has an elastic attachment device for detachably securing the unitary liner structure to the receptacle attachment device by expanding the elastic attachment device circumferentially, fitting the elastic attachment device over the attachment lip and into a position below the attachment lip, and releasing the elastic attachment device to permit the elastic attachment device to compressibly mate with the receptacle below the attachment lip. Each of the liners has a pull grip for gripping the liner to remove the liner from the unitary liner structure and perforations disposed between the pull grip and the elastic attachment device for tearing the liner when a tearing force is applied thereto.

26 Claims, 12 Drawing Sheets

FIG. 1
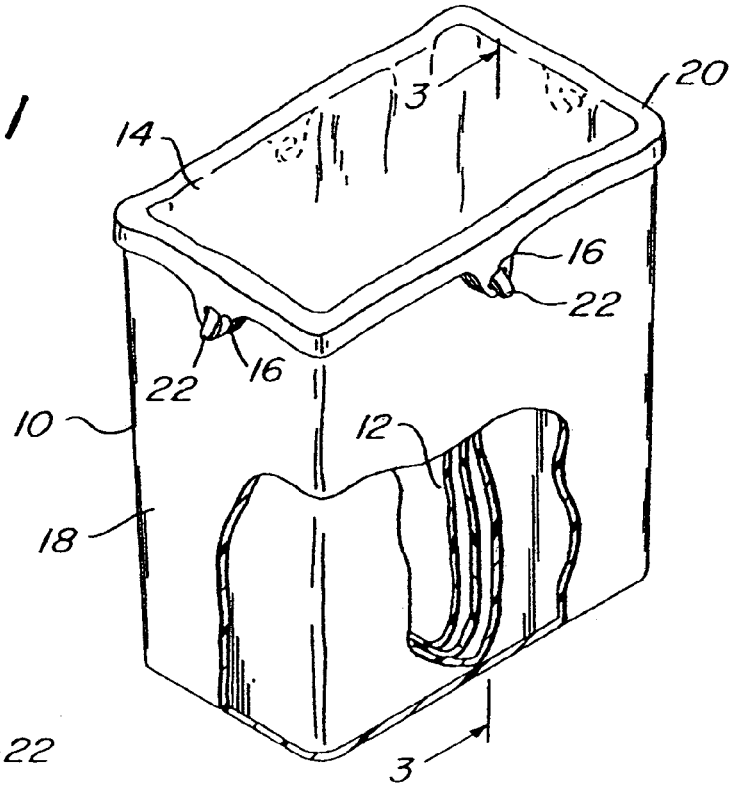
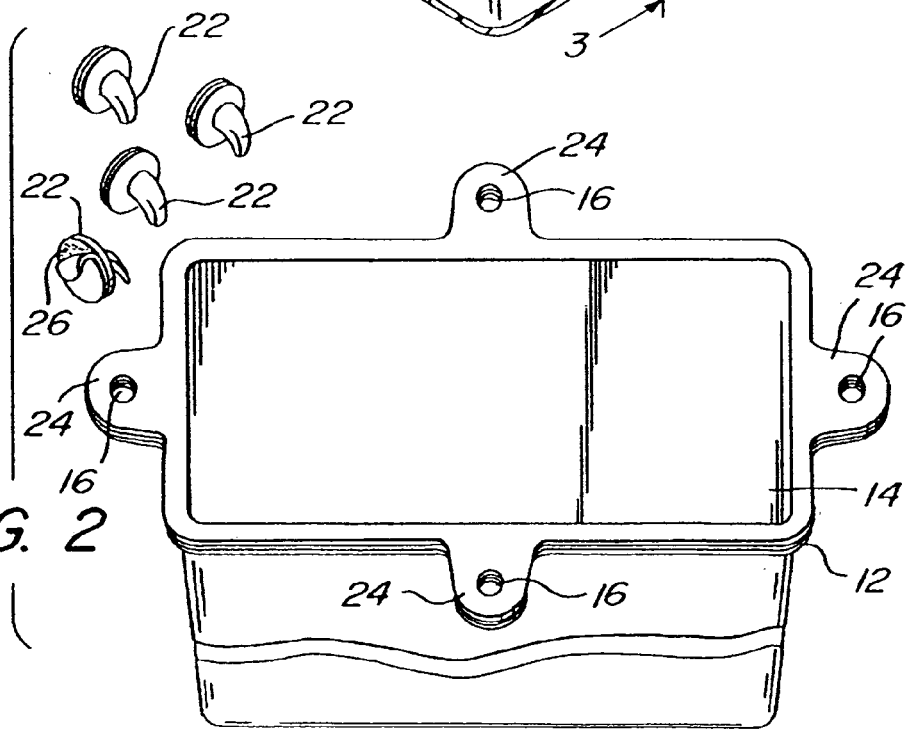
FIG. 2

FIG. 3
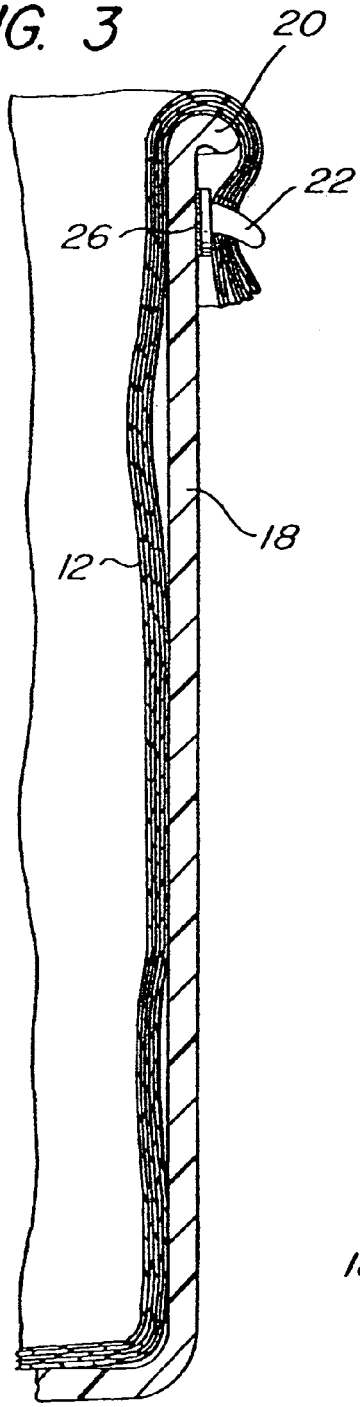
FIG. 4
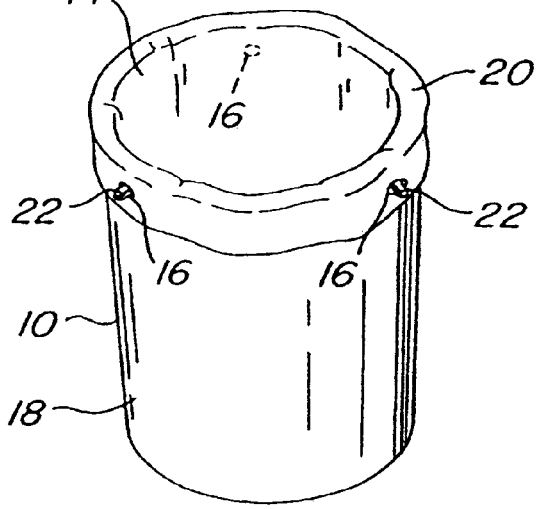
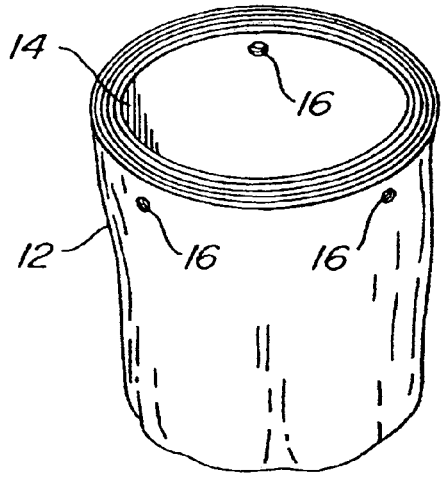
FIG. 5
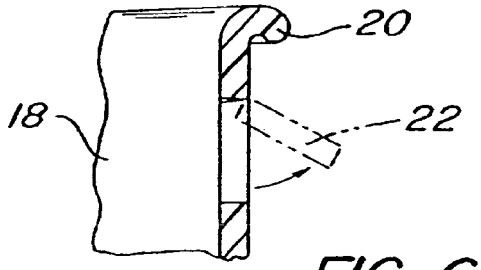
FIG. 6

FIG. 14
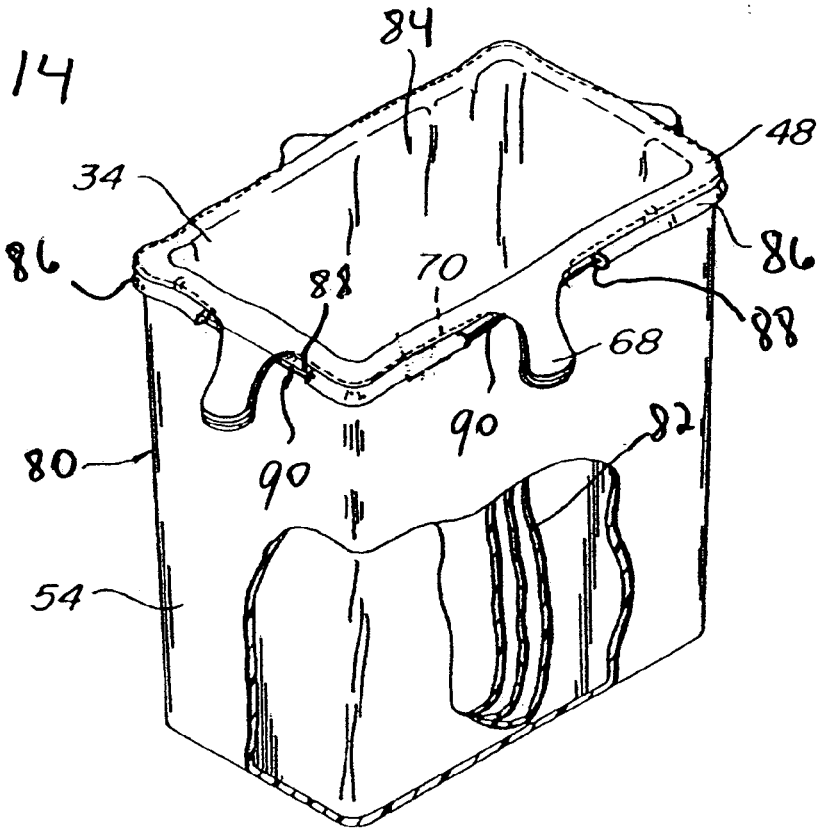
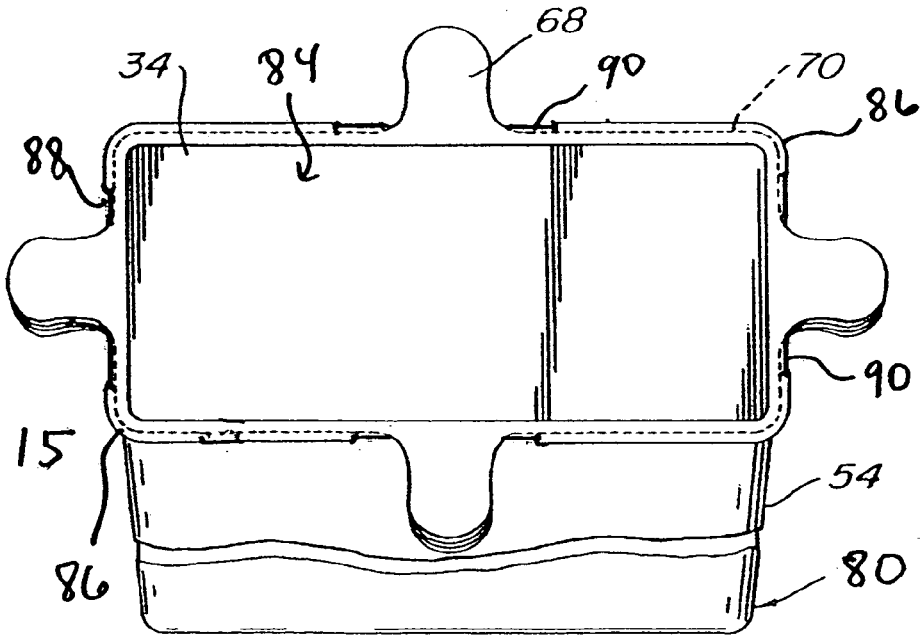
FIG. 15

PACKING AND WASTE DISPOSAL SYSTEM

BACKGROUND OF THE INVENTION

FIELD OF INVENTION

This invention relates to packaging and waste disposal systems in general, and particularly to packaging receptacles and waste disposal receptacles incorporating means for removably retaining a plurality of nested liners.

Lined receptacles have long been known, but two constant problems have been the need to provide a close fit of the liner to the receptacle walls so as to assure entry of materials being packed solely within the liner and also to prevent the inserted liner from slipping to the bottom of the receptacle or onto the contents therein when one is dropping material into a lined receptacle. Moreover, removing a filled liner from the receptacle, searching for a replacement liner and installing the new liner in the receptacle can be tedious and inconvenient.

Prior receptacles have not solved these problems efficiently. Prior receptacles often require complex, costly, multi-part holding or clamping structures, or are difficult to use even if simplified.

For example, U.S. Pat. No. 5,671,861 discloses a receptacle for removably holding a plurality of loop-handled plastic bags. The receptacle includes cleats projecting upwardly from opposing inside walls and fingers projecting downwardly from other opposing inside walls. The handles of the bags hang from the cleats with the balance of the bag opening pinned against the inside walls by the fingers.

U.S. Pat. No. 4,938,380 discloses a trash receptacle provided with four ears, one at each corner, to support a bag liner preferably having incorporated handles. In particular, the ears are intended to have the bag handles looped around them such that the bag's sides hug the container walls, thus assuring that all refuse is captured within the liner bag. To this end, a tip of each ear protrudes beyond and above a rim around the opening, requiring the handles to be stretched over them, and a notch in the exterior of each ear near the container corner lies well below the rim, causing the bag's edges outside the handle area also to be held in desired relation to the walls.

U.S. Pat. No. 3,825,150 discloses a molded waste receptacle having integral tabs formed in its side walls, the tabs being pressed inwardly to engage a rolled-over edge of a liner bag and pinch it against the receptacle wall when pressing is ended. Simultaneous manipulation of both a tab and the edge requires some dexterity, and furthermore, the occurrence of gaps between the liner bag and the wall is not prevented, allowing waste disposal to occur between liner and receptacle.

U.S. Pat. No. 4,366,916 discloses a packing box for bulk quantities of flexible bags with carrying handles, the box being convertible into a packing unit for the bags, because of provision of pre-perforated front panel and side flaps, the latter folding upward to provide tabs upon which the bag handles are received. Control of gaps between bag and receptacle is not provided and the box is not a leak-proof unit because of the pre-perforations.

U.S. Pat. No. 4,418,835 discloses a pair of wire brackets, each bracket supporting the handle of a liner bag and being fastened in spaced relation to the interior of a respective wall of a trash receptacle. The spacing is necessary for accommodating the user's fingers while inserting and removing the bag, even though such spacing undesirably allows waste disposal to occur between bag and receptacle. Furthermore, if the bag is overfilled, these internally-disposed brackets can present a barrier to easy removal of the liner even though the bag's handles are readily grasped.

U.S. Pat. No. 4,498,652 discloses a wire rack for suspending a plastic bag by its handle loops in an open-mouthed state of the bag, a protective wall being present on one side only (the rack being fastened to a cabinet door on that side).

U.S. Pat. No. 6,102,239 discloses a material packaging system including nested liners that were removably attached to each other to form a unitary liner structure and a receptacle having an attachment device for detachably securing the unitary liner structure to the receptacle. The unitary liner structure had a second attachment device for detachably securing the second attachment device to the attachment device of the receptacle. In an alternate embodiment, a drawstring within a circumferential a sheath for retaining the drawstring was provided for performing the detachable attachment.

Each of the liners had a pull grip for gripping the liner to remove the liner from the unitary liner structure and perforations disposed between the pull grip and the second attachment device for tearing the liner when a tearing force was applied. An uppermost liner of the plurality of liners was thus removed from the unitary liner structure without substantially disturbing the positioning of underlying liners by gripping and pulling the pull grip of the uppermost liner to apply the tearing force to the perforations of the uppermost liner.

Even though the foregoing system represented an improvement over the prior art, it still required the inconvenience of attaching and detaching the liner structure to the receptacle by techniques such as inserting a number of projections through openings or by pulling and releasing the drawstring, as by operating a drawstring clip. Accordingly, there is need for a receptacle in which support of a liner structure is provided in a simple, low-cost, conveniently and quickly usable fashion, including a simplified method for attaching and detaching the liner structure.

DESCRIPTION OF RELATED ART

All references cited herein are incorporated herein by reference in their entireties.

BRIEF SUMMARY OF THE INVENTION

An improved material packaging system includes a plurality of nested liners removably attached to each other to form a unitary liner structure and a receptacle having a circumferential attachment lip for detachably securing said unitary liner structure to said receptacle. The unitary liner structure has an elastic attachment device for detachably securing the unitary liner structure to the receptacle attachment by expanding the elastic attachment device circumferentially, fitting the elastic attachment device over the attachment lip and into a position below the attachment lip, and releasing the elastic attachment device to permit the elastic attachment device to compressibly mate with the receptacle below the attachment lip. Each of the liners has a pull grip for gripping the liner to remove the liner from the unitary liner structure and perforations disposed between the pull grip and the elastic attachment device for tearing the liner when a tearing force is applied thereto. Thus, an uppermost liner of the plurality of liners can be removed from the unitary liner structure without substantially disturbing the positioning of underlying liners by gripping and pulling the pull grip of the uppermost liner to apply the tearing force to the perforations of the uppermost liner.

BRIEF DESCRIPTION OF SEVERAL VIEWS OF THE DRAWINGS

The invention will be described in conjunction with the following drawings in which like reference numerals designate like elements and wherein:

FIG. 1 is a perspective view of an embodiment of a packaging system with a partial cross-sectional view;

FIG. 2 is a perspective view of an embodiment of a kit of the system of FIG. 1;

FIG. 3 is a partial cross-sectional view through line 3—3 of FIG. 1;

FIG. 4 is a perspective view of another embodiment of a packaging system of FIG. 1;

FIG. 5 is a perspective view of the nested liners of the embodiment of FIG. 4;

FIG. 6 is a partial cross-sectional view of retractable projections of the FIG. 1;

FIG. 14 is a partial cross-sectional perspective view of a preferred embodiment of the packaging system of FIG. 7 including an elastic attachment device;

FIG. 15 is a further perspective view of the packaging system of FIG. 14.

DETAILED DESCRIPTION OF THE INVENTION

Figure 7:
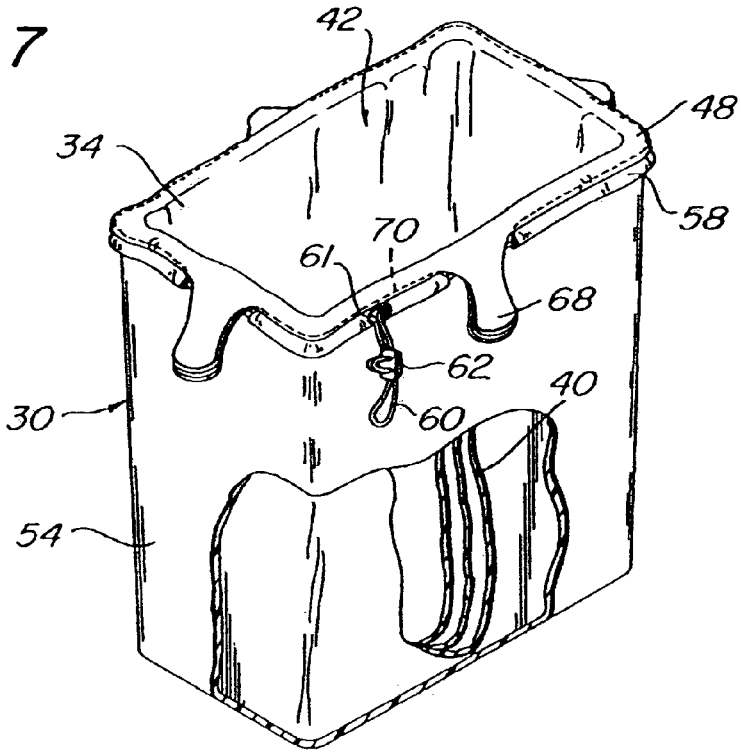
FIG. 7 is a perspective view of a preferred embodiment of a packaging system of FIG. 1 including a partial cross-sectional view.

The invention will be illustrated in more detail with reference to the following Examples, but it should be understood that the present invention is not deemed to be limited thereto.

Referring to FIG. 1, the material packaging system 10 comprises a plurality of nested liners 12 for receiving a material (not shown). As best shown in FIGS. 2 and 5, each of liners 12 has a material-receiving mouth 14 at a top end thereof and at least two apertures 16 (preferably at least three apertures 16, as shown) through said top end. Liners 12 are closed at the bottom ends thereof.

System 10 further comprises a receptacle 18 adapted to removably retain nested liners 12 in an open configuration for receiving the material to be packed. The material to be packed is not limited, and can be any material to be stored or disposed of, for example, waste material.

Receptacle 18 comprises a lip 20 and at least two external projections 22 (preferably at least three external projections 22, as shown) adapted to penetrate apertures 16 when liners 12 are positioned inside receptacle 18. As best shown in FIG. 3, the uppermost portions of liners 12 overlap lip 20. These features combine to removably retain nested liners 12 in receptacle 18. An uppermost one of liners 12 can be removed from receptacle 18 without substantially disturbing the positioning of underlying nested liners in the receptacle.

The shape of liners 12 and receptacle 18 are not limited, except that preferably the shapes of liners 12 should substantially conform to the shape of receptacle 18. For example, the rectangular liners 12 of FIG. 2 are suitable for the rectangular receptacle 18 of FIG. 1, while the cylindrical liners 12 of FIG. 5 are suitable for the cylindrical receptacle 18 of FIG. 4.

Receptacle 18 is preferably open at only the top end thereof. However, in other embodiments, receptacle can be, for example, open along additional areas, and can even be an open frame in which liners 12 are draped. In addition, receptacle 18 can include a lid, although this is not shown in the figures.

The number and placement of apertures 16 and projections 22 are important factors for maintaining adequate functioning of system 10. It is preferred that there be at least three spaced-apart apertures 16 and three corresponding projections 22, to ensure that liners 12 maintain a close seal over lip 20 of receptacle 18. Having less than three apertures 16 and projections 22 is less preferred (but still within the scope of the invention, which encompasses at least two apertures and at least two projections) because it can result in gapping of liners 12 about lip 20, creating opportunities for the material being packed to bypass liners 12 and enter receptacle 18 directly. There is no particular upper limit on the number of apertures 16 and corresponding projections 22; however, there should not be so many that installation and removal of liners 12 is inconvenient.

Apertures 16 are preferably placed along the top end of liners 12, sufficiently spaced apart to avoid the aforementioned gapping problem. Projections 22 are correspondingly spaced-apart on the outside surface of receptacle 18, so that they readily penetrate the corresponding apertures 16, as shown in FIGS. 1 and 4. Projections 22 can be placed at any relative height along the outside surface of receptacle 18, depending on the desired proportion of each liner 12 to be used for lining the inside of receptacle 18. For example, projections can be placed about 10 cm down the outside surface of receptacle 18, so as to provide a readily grippable portion of liner 12 for removing and sealing liner 12 after it has been filled to the top of receptacle 18. On the other hand, projections 22 can be placed closer to the top of receptacle 18 to minimize the proportion of liner 12 wasted (i.e., the proportion of liner 12 filled with material is maximized).

Apertures 16 are preferably not loop handles for carrying liner 12, but rather are preferably less than about 5 centimeters in diameter, more preferably less than about 2.5 centimeters in diameter.

Projections 22 are preferably hook-shaped, and are placed on the outside surface of receptacle 18 with the hook opening in a downward direction, such that apertures 16 can slide over projections 22 and be held in place by the upward tension provided by the weight of liners 12 within receptacle 18. Projections 22 need not be hook-shaped, however. The shape of projections 22 is dictated by their effect on the ease of installing and removing liners 12 and the stability of the installation during use of system 10.

FIG. 6 shows a retractable projection 22, which retracts from the wall of the receptacle to assume a downwardly angled position for receiving and holding liners 12 via apertures 16. Retractable projection 22 demonstrates that the projection need not be curved to function properly.

The materials from which the various elements of system 10 are manufactured are not particularly limited. Non-limiting examples of suitable materials for receptacle 18 and projections 22 include metal, plastic, wood and cardboard. In certain embodiments, projections 22 and receptacle 18 are unitary, in other embodiments they are not unitary. Non-limiting examples of suitable materials for liners 12 include plastic and paper.

FIG. 2 shows the contents of a kit for retrofitting a conventional (or projection-free) receptacle to create a material packaging system. An embodiment of the kit includes rectangular, nested liners 12 having four walls, each wall having a corresponding tongue 24 attached to a top end thereof. Tongue 24 is adapted to overlap receptacle lip 20 and comprises one aperture 16 for receiving a corresponding one of four external projections 22, which are also included in the kit. Tongues 24 can also be used to tie liners 12 closed after liners 12 are removed from receptacle 18. Projections 22 preferably include adhesive backing 26 for attachment to the receptacle to be retrofitted.

Figure 8:
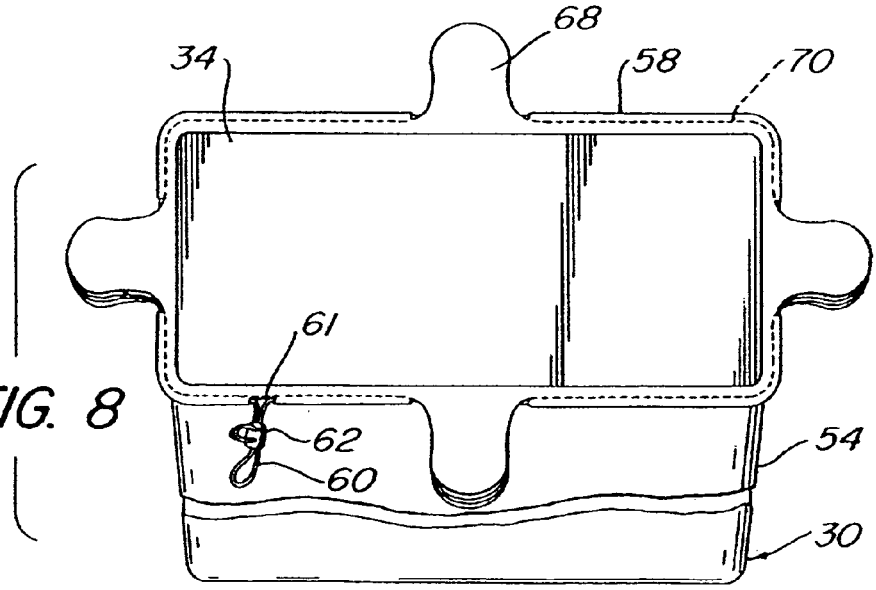
FIG. 8 is a further perspective view of the packaging system of FIG. 7.

Referring to FIGS. 7 and 8, material packaging system 30 is shown. Material packaging system 30 is an alternate embodiment of material packaging system 10. As previously described with respect to material packaging system 10, material packaging system 30 includes a plurality of nested liners 40. Nested liners 40 are formed as unitary liner structure 42. Each nested liner 40 has a material-receiving mouth 34 at a top end thereof. Nested liners 40 are closed at their bottom ends in order to permit them to retain received material.

Material packaging system 30 also includes a receptacle 54 adapted to removably retain nested liners 40 in a open configuration for receiving the material to be packed within liners 40. The material to be packed is not limited and can include, e.g., waste material. Receptacle 54 includes lip 48 extending outwardly from the top thereof. When nested liners 40 are disposed within receptacle 54, an upper circumferential region of unitary liner structure 42 can rest upon lip 48.

Figure 11:
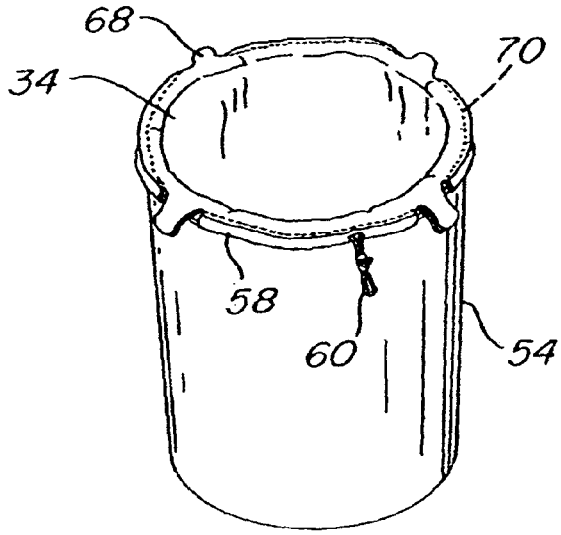
FIG. 11 is a further embodiment of the packaging system of FIG. 5.

The shape of nested liners 40 and receptacle 54 is not limited, except that preferably the shape of liners 40 should substantially conform to the shape of receptacle 54. For example, rectangular liners 40 of FIGS. 7 and 8 are suitable for rectangular receptacle 54 shown therein. Referring to FIG. 11, it can be seen that the shape of receptacle 54 can be, for example, round and that round liners 40 are preferably provided for round receptacle 54.

Receptacle 54 is preferably open at only the top end thereof. However, in other embodiments, receptacle 54 can be open along other areas. Furthermore, receptacle 54 can be an open frame in which nested liners 40 are disposed. Additionally, receptacle 54 can include a lid, although a lid is not shown in the drawings.

Figure 9:
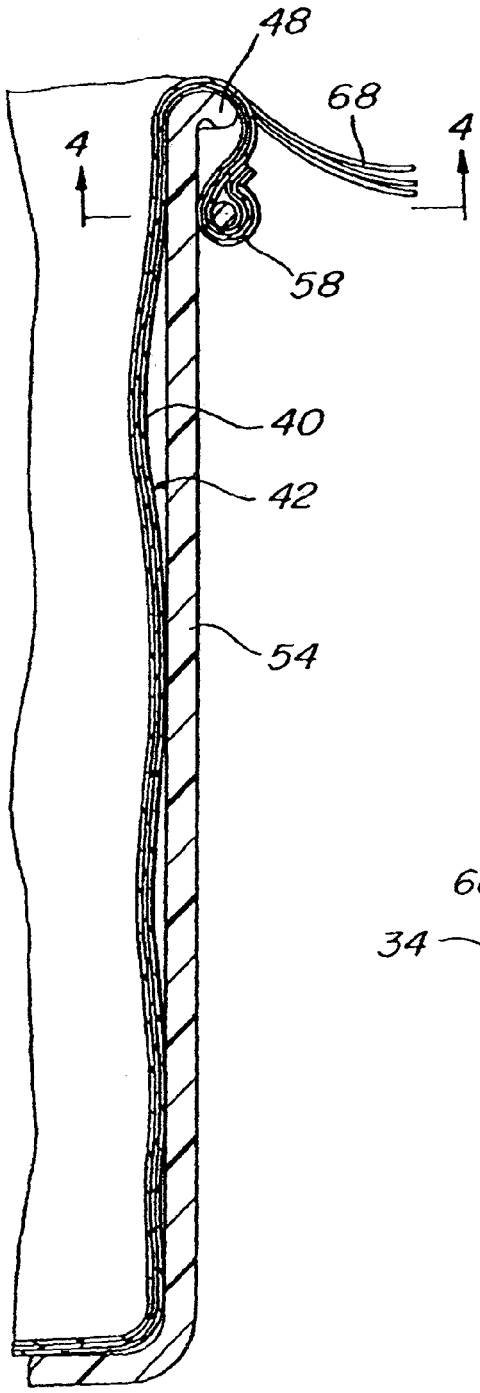
FIG. 9 is a cross-sectional view of the packaging system of FIG. 7.
Figure 10:
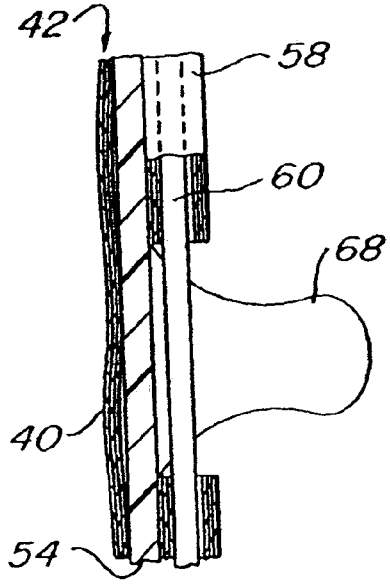
FIG. 10 is a cross-sectional view of the packaging system of FIG. 7.

Referring now to FIGS. 9 and 10, there are shown cross sectional views of material packaging system 30. Within material packaging system 30 unitary liner structure 42 is formed with sheath 58. Sheath 58 can extend around the entire circumference of material-receiving mouth 34 at the top end of nested liners 40. Drawstring 60 (FIG. 7) can extend through the entire length of circumferentially extending sheath 58. An opening 61 is provided through a sidewall of sheath 58 to permit drawstring 60 to extend therethrough for access by a user.

When nested liners 40 are disposed within receptacle 54 the portion of nested liners 40 bearing sheath 58 is adapted to reach from the interior of receptacle 54, over the top of receptacle 54, and to a position below lip 48. When nested liners 54 are installed in receptacle 54 in this manner drawstring 62 is drawn tight by forcibly pulling drawstring 60 away from receptacle 54, thereby drawing a length of drawstring 60 from within sheath 58 by way of opening 61.

A locking clip 62 is provided on drawstring 60 in order to secure drawstring 60 in a tightened position around receptacle 54 and below lip 48. Preferably, locking clip 62 is brought into forcible contact with sheath 58 in the vicinity of opening 61 and forcibly maintained in such a position. In this manner circumferential sheath 58 and thereby unitary liner structure 42 are mated with and tightly secured to receptacle 54 below the exterior of lip 48.

It will be understood by those skilled in the art that it is not necessary for sheath 58 to extend continuously around the entire circumference of unitary liner structure 42. Sheath 58 can be discontinuous provided it extends a sufficient distance to retain drawstring 60 and to secure unitary liner structure 42 to receptacle 54 as described. Furthermore, it is not required that drawstring 60 extend the entire circumferential distance around unitary liner structure 42 provided it is adapted to secure unitary liner structure 42 to receptacle 54. For example, in one embodiment (not shown) drawstring 60 can be attached at two locations along a circumference of unitary liner structure 42 whereby pulling drawstring 60 away from receptacle 54 can draw the two attachment locations toward each other and thereby secure unitary liner structure 42 to receptacle 54.

When nested liners 40 of unitary liner structure 42 are secured to receptacle 54 material packaging system 30 is adapted to permit an uppermost liner 40 to be removed from receptacle 54 without substantially disturbing the positioning of an underlying nested liner 40 in receptacle 54. In order to facilitate such a removal of uppermost liner 40 each nested liner 40 is provided with at least one pull tab 68 for gripping a nested liner 40 and pulling the gripped liner 40 away from receptacle 54. In a preferred embodiment four pull tabs 68 are provided on each nested liner 40. Pull tabs 68 can also be used to tie nested liner 40 closed after nested liner 40 are removed from receptacle 18.

Perforated line 70 is also provided on each liner 40 of the plurality of liners 40 in order to facilitate such a removal of uppermost liner 40. In a preferred embodiment perforated line 70 extends continuously around the entire circumference of unitary liner structure 42, although it is not necessary for perforated line 70 to be continuous or to extend the entire circumference. Perforated line 70 is disposed between sheath 58 and tabs 68. Preferably perforated line 70 extends parallel to sheath 58 and is disposed close to sheath 58.

Perforated line 70 facilitates the tearing of liner 40 from the plurality of liners 40 when a tearing force is applied to the region of perforated line 70. The tearing force for tearing liner 40 along perforated line 70 is applied to the region of perforated line 70 when pull tab 68, on one side of line 70, is pulled away from receptacle 54 while sheath 58, on the opposing side of perforated line 70, remains secured to receptacle 54.

Figure 12:
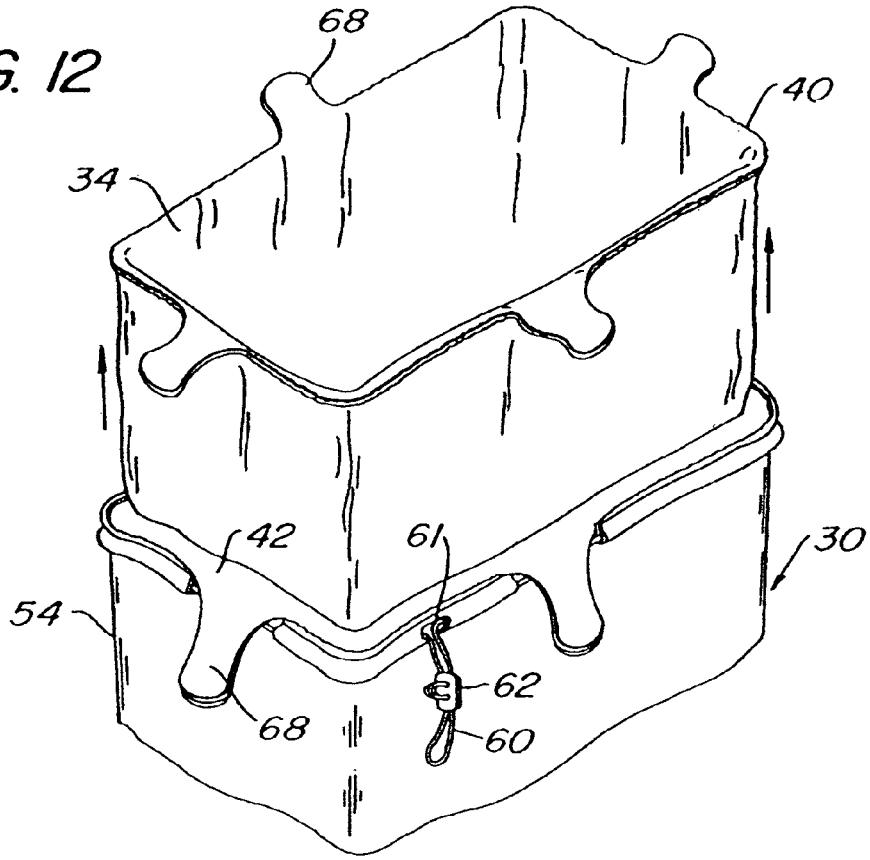
FIG. 12 is a perspective view an alternate embodiment of the packaging system of FIG. 7.
Figure 13:
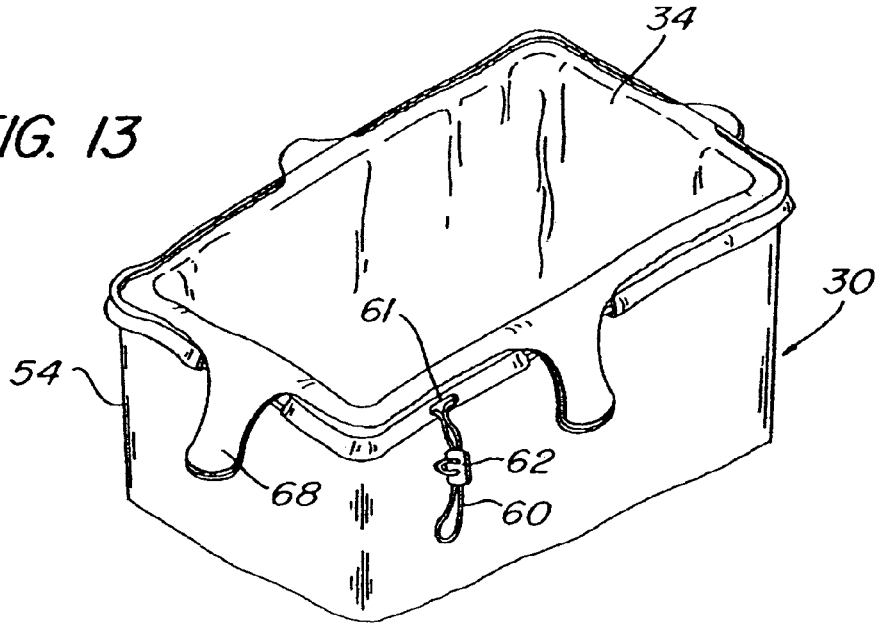
FIG. 13 is a perspective view of the packaging system of FIG. 7.

Thus, when uppermost liner 40 is ready for removal from receptacle 54 a user can grip pull tab 68 of uppermost liner 40 and pull it upwards and away from receptacle 54. The force away from receptacle 54 applied to uppermost liner 40 causes uppermost liner 40 to tear away from the remainder of the plurality of nested liners 40 along perforation 70. The removal of uppermost liner 40 while the remaining liners 40 are secured to receptacle 54 is shown in FIGS. 12 and 13.

While the sheath retaining structure 48 shown in the drawings is a lip 48, any structure suitable for retaining sheath 58 can be used instead of a lip structure. For example, one or more extensions, including various types of projections, flanges, and hooks, as well as hook and loop material, can serve to retain sheath 58 of unitary liner structure 42 when drawstring 60 is tightened below them. Furthermore, any type of gripping device for gripping and pulling liners 40 can be substituted for pull tabs 68. For example, openings near the top of liners 40 to permit the gripping of liners 40 by inserting a finger or fingers therethrough or even an accessible edge of a liner 40 for permitting the gripping of liner 40 can serve as suitable gripping devices.

Figure 16A:
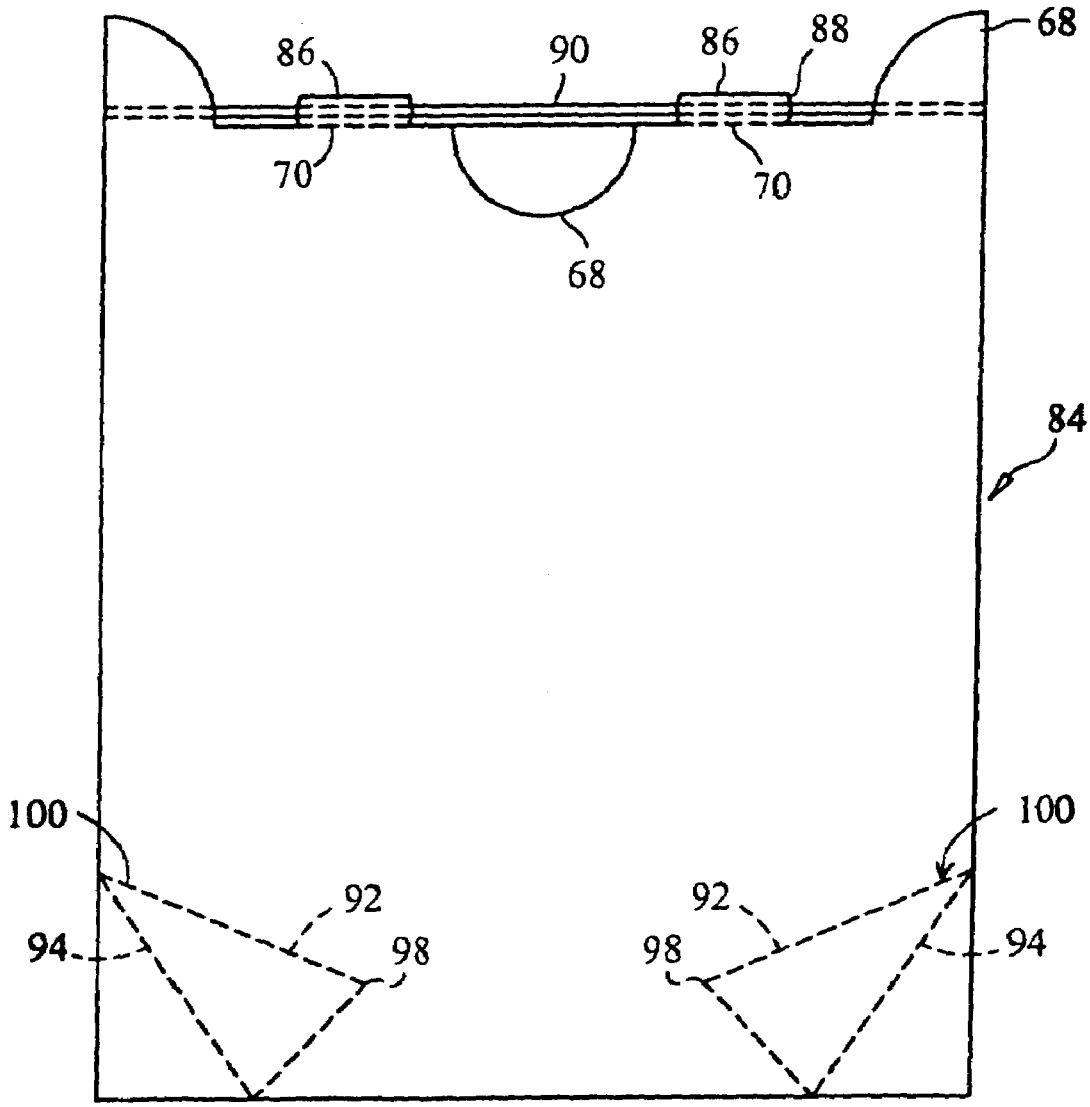
FIGS. 16A and 16B are a side view and a partial side view, respectively, of a unitary liner structure having the elastic attachment device of FIG. 14.

Referring to FIGS. 14 and 15, material packaging system 80 including unitary liner structure 84 having elastic attachment device 90 is shown. A partial side view of material packaging system 80 is shown in FIGS. 16A,B. Material packaging system 80 is an alternate embodiment of material packaging system 30. Material packaging system 80 includes a unitary liner structure 84 having a plurality of nested liners 82 and a receptacle 54 adapted to removably retain nested liners 82. Receptacle 54 includes lip 48 extending outwardly from the top thereof in order to assist in retaining nested liners 82. The shape of nested liners 82 and receptacle 54 is not limited.

Figure 16B:
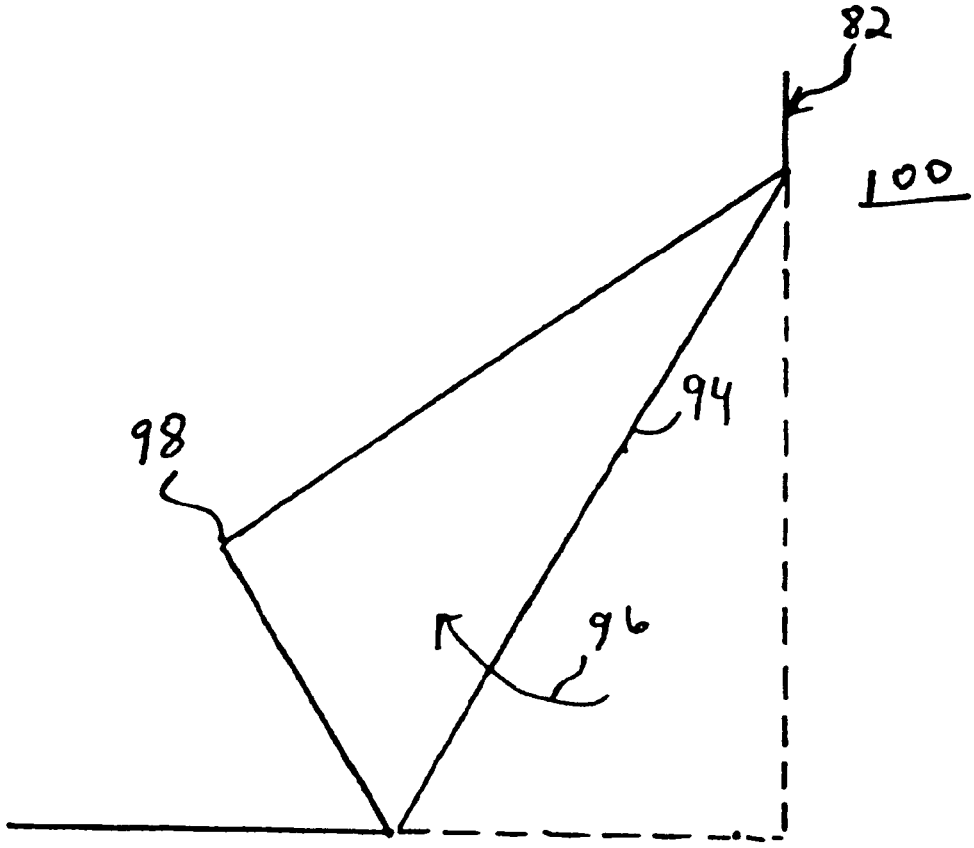

Each nested liner 82 of unitary liner structure 84 has a material-receiving mouth 34 at a top end thereof. Nested liners 82 are closed at their bottom ends in order to permit them to retain received material. In the preferred embodiment of the unitary liner structures of the present invention, the individual nested liners can be provided with radially inward folds 100 at the bottom thereof. In order to form a radially inward fold 100 a bottom corner 98 of a nested liner is disposed against a side of the liner by moving the bottom corner 98 in a radially inward direction as indicated by arrow 96 of FIG. 16B to create a fold in the liner at a fold line 94. Folds 100 prevent the corners 98 of a nested liner from becoming engaged with the corners 98 of any nested liners immediately adjacent to it within a unitary liner structure. Thus, a nested liner can be more easily removed from a unitary liner structure after the perforations are torn and the liner is pulled away from a receptacle 54.

Unitary liner structure 84 can be detachably secured to receptacle 54 by placing the bottom of the unitary liner structure 84 through the mouth 34 of receptacle 54 and preferably disposing the bottom of unitary liner structure 84 below the level of mouth 34 of receptacle 54. Elastic attachment device 90 is then forcibly circumferentially expanded to circumferentially fit elastic attachment device 90 over the lip 48 of receptacle 54 and dispose elastic attachment device 90 at a location below the lip 48. Elastic attachment device 90 is then released and permitted to compressibly mate with an outer circumference of receptacle 54 in a region below lip 48 by applying inward force on the outer circumference of receptacle 54.

Thus, unitary liner structure 84 can be mated with and tightly secured to receptacle 54 using an elastic attachment device. When nested liners 82 are mated with receptacle 54 in this manner, an upper circumferential region of unitary liner structure 84 can rest upon lip 48 of receptacle 54. Unitary liner structure 84 can be removed from receptacle 54 by again applying expanding force to elastic attachment device 90 and pulling elastic attachment device 90 up over lip 48.

Unitary liner structure 84 can be formed with a plurality of portions of sheath 86 spaced apart by openings 88 around the entire circumference of nested liners 82 at the top end thereof, wherein each of the portions of sheath 86 surrounds a corresponding portion of elastic attachment device 90. The openings 88 between the portions of sheath 86 permit easy access to elastic attachment device 90 therethrough by a user in order to permit the user to grip elastic attachment device 90 and apply expanding force to it. Although unitary liner structure 84 it shown with four openings 88 and four corresponding sheath portions 86, unitary liner structure 84 can be formed with any number of corresponding spaced apart openings 88 and sheath portions 86.

Additionally, while elastic attachment device 90 can be formed as a single continuous elastic band, it can be formed as a non-continuous band having ends which can be tied or joined together, as with a clip. Such a clip can be formed of, for example, plastic, metal or rubberized cloth or any other device for securing the ends thereof. Elastic attachment device 90, whether continuous or non-continuous, can be formed of rubber, a combination of rubber and cloth, or any other elastic material which permits it to be expanded to fit over lip 48 and to compressibly mate with receptacle 54 when it is released.

It is not required that elastic attachment device 90 extend the entire circumferential distance around unitary liner structure 42, provided it is adapted to secure unitary liner structure 42 to receptacle 54 in the manner described. For example, in other embodiment of the invention (not shown) two or more sections of elastic attachment device 90 can be attached at locations along a circumference of unitary liner structure 42. The sections of such an elastic attachment device can be joined to unitary liner structure 84 by, for example, sewing. In these embodiments, expanding force as previously described can be applied to the sections of elastic attachment device 90 to expand them to fit them over lip 48, and the sections of elastic attachment device 90 can be released to compressibly secure unitary liner structure 42 to receptacle 54.

The materials from which the various elements of material packaging system 80 are manufactured are not limited. Non-limiting examples of suitable materials for forming receptacle 54 can include metal, plastic, wood and cardboard. Non-limiting examples of suitable materials for nested liners 82 can include plastic and paper.

It will be understood that drawstring 60 of material packaging system 30 as shown in FIGS. 7 and 8 can also be formed of an elastic band in order to provide compressive force when nested liners 40 are mated with receptacle 54 for assisting in forming a secure mating relationship between nested liners 40 and receptacle 54. Such an elastic drawstring 60 can be formed as a continuous or a non-continuous band that is joined at its ends as described with respect to elastic attachment device 90.

Additionally, in one preferred embodiment of material packaging system 30 locking clip 62 can be replaced with a conventional spring operated pull clip (not shown) in order to releasably apply additional inward tightening tension to receptacle 54. Using such a spring operated pull clip the spring is pushed and the continuous or non continuous drawstring 60 is pulled in order to tighten the drawstring 60 around the receptacle 54. The spring of the pull clip is then released and the drawstring is thereby locked in a tightened state. In order to remove the remove the nested liners from the receptacle 54 the spring of the pull clip is pushed again and the pull clip can be pulled away from the receptacle, thereby allowing the drawstring 60 to slide therethrough.

Figure 18:
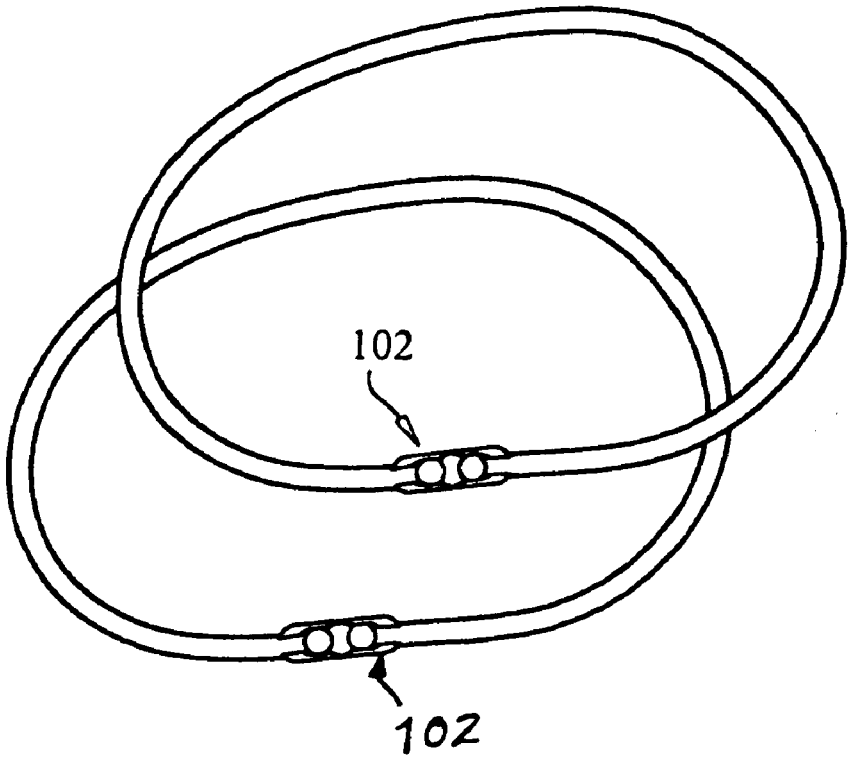
FIG. 18 is a further alternate embodiment of the elastic attachment device of FIG. 14.
Figure 19:
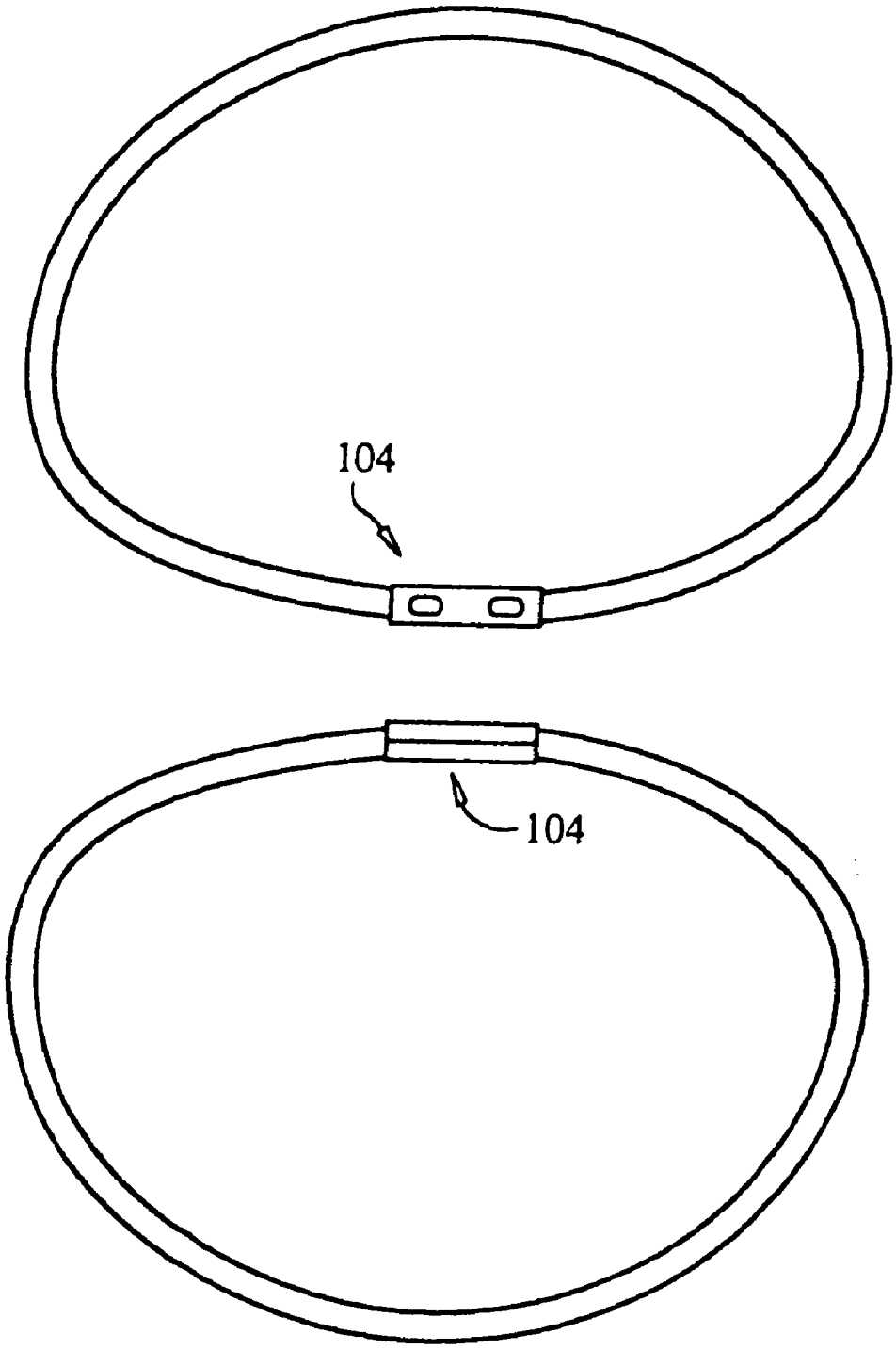
FIG. 19 is an alternate embodiment of the unitary liner structure of FIGS. 16A and 16B.

Referring now to FIGS. 18 and 19, there are shown two alternate preferred embodiments of elastic attachment device clips 102, 104 for attaching the opposing ends of a non-continuous elastic band to each other in order to form the elastic attachment device 90 of the present invention. Elastic attachment device clip 102 is a conventional pull chain clip of the type used to detatchably grasp a ball on a chain formed of a series of balls and used as a pull chain for an electric lamp. When joining the ends of an elastic band to form an elastic attachment device 90 using pull chain clip 102 the ends of the elastic band are preferably knotted prior to insertion into the pull chain clip 102 and the ends of the pull chain clip 102 are forcibly compressed tightly around the knots to prevent the ends of the elastic band from slipping out of the clip 102.

Alternately, elastic attachment device clip 104 formed of a conventional hair band clip of the type used to join the ends of an elastic band to form a hair band, for example a hair band conventionally used for holding a pony tail. In order to form elastic attachment device using hair band clip 104 the ends of the elastic band are inserted into the ends of the hair band clip 104 and the ends of the hair band clip 104 are forcibly compressed tightly around the ends of the elastic band. Additionally, the hair band clip 104 is crimped to assist in further gripping the elastic band therein to prevent the ends of the elastic band from slipping out of the clip 104. An advantage of the hair band clip 104 is that the ends of the elastic band do not have to be knotted before inserting them into the hair band clip 104 and compressing the hair band clip 104 around the elastic band.

Additionally, it will be understood that the ends of an elastic band can be joined to each other by any other type of clip or in any manner known to those skilled in the art, with or without a clip. For example, the ends of the elastic band can be heat sealed to each other. Furthermore, when a clip is used to join the ends of an elastic band to form the elastic attachment device 90, the clips can be formed of any suitable material, for example, metal or plastic.

Figure 17A:
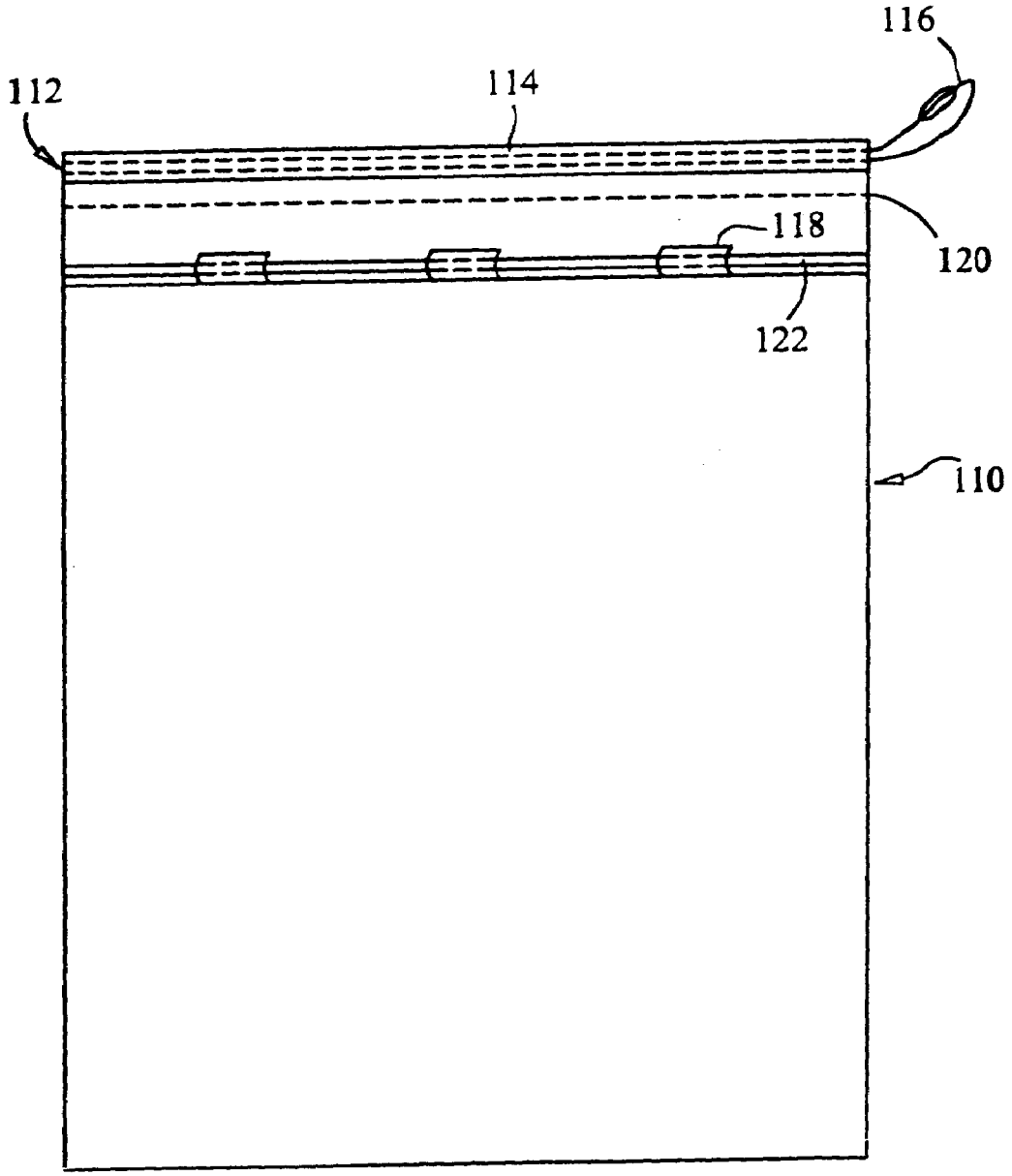
FIGS. 17A and 17B are alternate embodiments of the elastic attachment device of FIG. 14.

Referring to FIGS. 17A,B, alternate embodiments of unitary liner structure 110 is shown. Unitary liner structure 110 is an alternate embodiment of unitary liner structure 82 containing a plurality of nested liners as previously described. The shape of the nested liners and receptacle 54 is not limited. Each nested liner within unitary liner structure 110 has a material-receiving mouth at a top end thereof. The nested liners within unitary liner structures 82, 110 are closed at their bottom ends in order to permit them to retain received material and in the preferred embodiment are manufactured by providing a transverse fold in the material they are formed of at the bottom thereof. This structure assist in maintaining a mating relation between the liner structure 82, 110 and the receptacle 54 when tearing off the topmost liner.

Each nested liner of unitary liner structure 110 is formed with a conventional cinch closure 112 at the top. Cinch closure 112 includes a drawstring 116 surrounded by a sheath 114. In one preferred embodiment drawstring 116 can be formed with a loop thereof extending outwardly from sheath 114 to permit easy gripping of drawstring 116 and closing of the nested liner. Sheath 114 need not extent around the circumference of unitary liner structure 110.

Figure 17B:
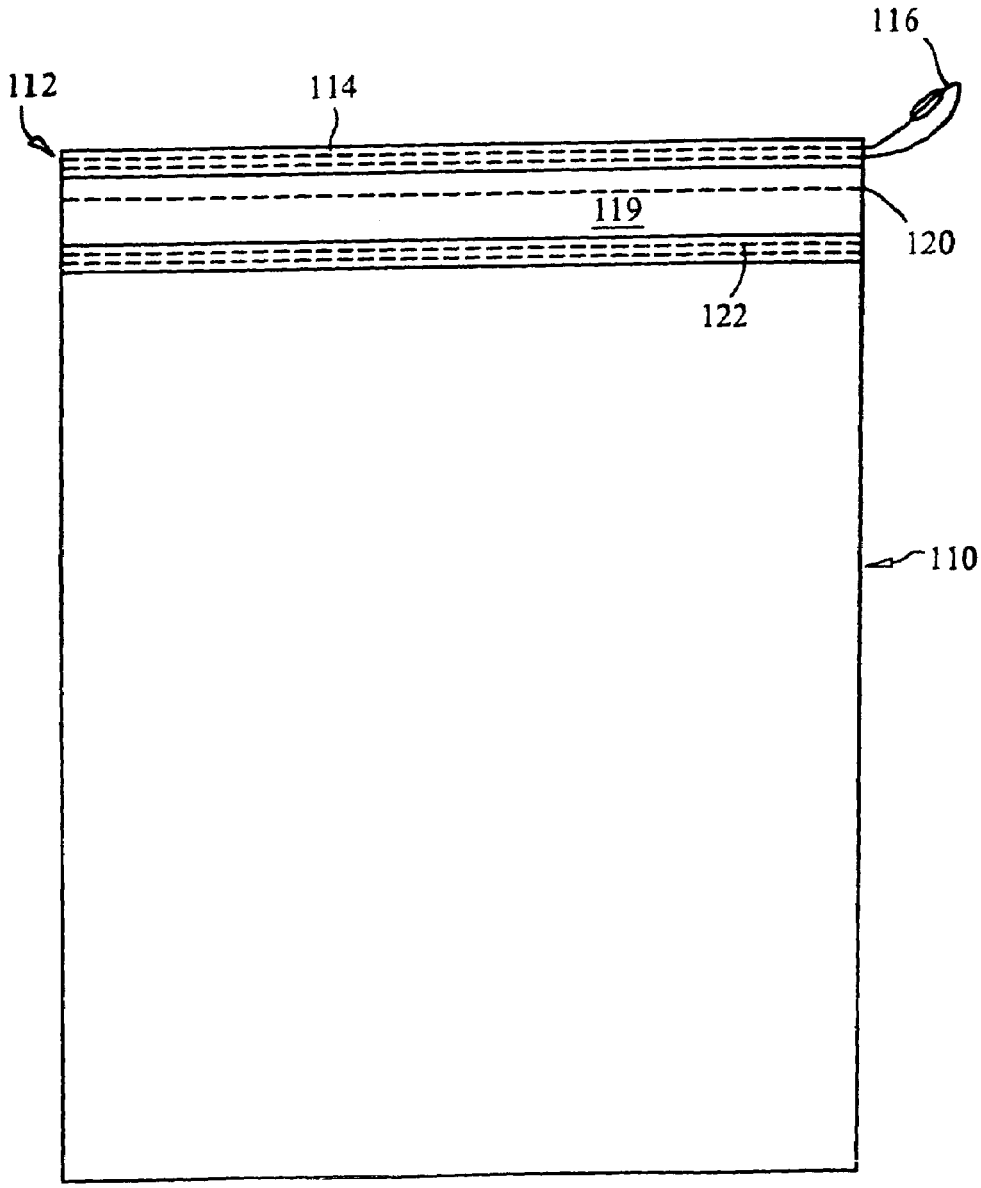

Perforations 120 are provided on each liner below cinch closure 112 for permitting individual liners of the unitary liner structure 110 to be separated therefrom when they are full. Additionally, elastic attachment device 122 is provided below perforations 120. Elastic attachment device 122 can be surrounded by sheath 119 extending around the entire circumference of elastic attachment device 110 (FIG. 17B) or by a sheath 118 formed in sections (FIG. 17A).

Unitary liner structure 110 can be detachably secured to receptacle 54 by placing the bottom of the unitary liner structure 110 through the mouth 34 of receptacle 54 and preferably disposing the bottom of unitary liner structure 84 below the level of mouth 34 of receptacle 54. Elastic attachment device 122 is then forcibly circumferentially expanded to circumferentially fit elastic attachment device 122 over the lip 48 of receptacle 54 and dispose elastic attachment device 122 at a location below the lip 48. Elastic attachment device 122 is then released and permitted to compressibly mate with an outer circumference of receptacle 54 in a region below lip 48 by applying inward force on the outer circumference of receptacle 54.

In this manner unitary liner structure 110 is mated with and tightly secured to receptacle 54. When unitary liner structure 110 is mated with receptacle 54 in this manner cinch closure 112 may gravitationally fall to a level below mateably secured elastic attachment device 122. Unitary liner structure 110 can be removed from receptacle 54 by again applying expanding force to elastic attachment device 122 and pulling elastic attachment device 122 up over lip 48 and removing the bottom of unitary liner structure 110 from receptacle 54.

After unitary liner structure 110 is mated with receptacle 54 perforations 120 are disposed between the circumference of receptacle 54 where unitary liner structure 110 is mated to receptacle 54 and drawstring 116. Thus, when drawstring 116 is grasped and forcibly pulled away from receptacle 54 a tearing force is applied to perforations 120. The tearing force applied to perforations 120 separates the topmost liner from the remaining liners of unitary liner structure 110.

While the invention has been described in detail and with reference to specific examples thereof, it will be apparent to one skilled in the art that various changes and modifications can be made therein without departing from the spirit and scope thereof.

What is claimed is:

1. An improved material packaging system, comprising:

(a) a plurality of nested liners removably attached to each other to form a unitary liner structure, each of said nested liners having a bottom portion inwardly folded for preventing engagement of said bottom portion with a bottom portion of an adjacent one of said nested liners;

(b) a receptacle having a circumferential attachment lip for detachably securing said unitary liner structure to said receptacle;

(c) said unitary liner structure having an elastic attachment device for detachably securing said unitary liner structure to said receptacle by expanding said elastic attachment device circumferentially, fitting said elastic attachment device over said attachment lip into a position below said attachment lip, and releasing said elastic attachment device to permit said elastic attachment device to compressibly mate with said receptacle below said attachment lip;

(d) each of said liners having a pull grip for gripping said liner to remove said liner from said unitary liner structure and perforations disposed between said pull grip and said elastic attachment device for tearing said liner when a tearing force is applied thereto; and (e) whereby an uppermost liner of said plurality of liners can be removed from said unitary liner structure without substantially disturbing the positioning of underlying liners by gripping and pulling said pull grip of said uppermost liner to apply said tearing force to said perforations of said uppermost liner.

2. The material packaging system of claim 1, wherein said elastic attachment device comprises an elastic band.

3. The material packaging system of claim 2, wherein said elastic band comprises a continuous elastic band.

4. The material packaging system of claim 2, wherein said elastic band comprises a non-continuous elastic band having its ends joined to each other.

5. The material packaging system of claim 4, wherein said non-continuous elastic band comprises a clip for performing said joining of said ends of said non-continuous elastic band to each other.

6. The material packaging system of claim 5, wherein said clip comprises a pull chain clip.

7. The material packaging system of claim 6, wherein each of said ends of said non-continuous elastic band is provided with a knot and each of said knots is compressibly maintained within said pull chain clip.

8. The material packaging system of claim 5, wherein said clip comprises a hair band clip.

9. The material packaging system of claim 8, wherein each of said ends of said non-continuous elastic band is inserted into said hair band clip and compressibly maintained within said hair band clip.

10. The material packaging system of claim 8, wherein hair band clip is crimped into said ends of said non-continuous elastic.

11. The material packaging system of claim 4, wherein said elastic band comprises a non-continuous elastic band having its ends joined to each other by heat sealing said ends to each other.

12. The material packaging system of claim 2, wherein said elastic band is provided with a spring operated pull clip for releasably applying tightening tension to said receptacle.

13. The material packaging system of claim 4, wherein said elastic attachment device comprises an elastic section.

14. The material packaging system of claim 13, wherein said elastic attachment device comprises a plurality of said elastic sections.

15. The material packaging system of claim 1, wherein said elastic attachment device extends around an entire circumference of said unitary liner structure.

16. The material packaging system of claim 15, wherein said elastic attachment device is disposed within a circumferential sheath for retaining said elastic attachment device.

17. The material packaging system of claim 5, wherein said circumferential sheath is provided with an opening for reaching through said opening to permit gripping of said elastic attachment device.

18. The material packaging system of claim 16, wherein said perforations are disposed substantially close to said elastic attachment device.

19. The material packaging system of claim 18, wherein said perforations are disposed along the side of said elastic attachment device.

20. The material packaging system of claim 1, wherein each of said liners of said plurality of liners comprises: (a) a plurality of liner walls defining a material-receiving mouth at a top end of said liner walls; and (b) a closed base joining said liner walls at a bottom end thereof.

21. The material packaging system of claim 20, wherein said closed base comprises a transverse fold in a material forming said liners of said plurality of liners.

22. The material packaging system of claim 1, wherein said liners of said plurality of liners comprise a closure device.

23. The material packaging system of claim 22, wherein said closure device comprises a drawstring.

24. The material packaging system of claim 22, wherein perforations are disposed between said closure device and said elastic attachment device whereby a tearing force is applied to said perforations when said unitary attachment structure is secured to said receptacle and said drawstring is forcibly pulled away from said receptacle.

25. The material packaging system of claim 1, wherein said bottom portion is a selected corner of each of said nested liners of said unitary liner structure being inwardly folded resulting in a folded corner to prevent engagement of said selected corner with a corner of an adjacent nested liner.

26. The material packaging system of claim 25, wherein each of said corners of each of said nested liners is folded.

* * * * *

UNITED STATES PATENT AND TRADEMARK OFFICE

CERTIFICATE OF CORRECTION

PATENT NO. : 7,080,750 B2
APPLICATION NO. : 10/661053
DATED : July 25, 2006
INVENTOR(S) : Abraham Wien et al.

It is certified that error appears in the above-identified patent and that said Letters Patent is hereby corrected as shown below:

On the title page item (12) under United States Patent
"wein" should read --wien--.
Title page Item [75] should read as follows:

Abraham Wien, Miami, FL (US);
Ralph Velocci, Golden Beach, FL (US)

Signed and Sealed this

Fifth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,080,750 B2
APPLICATION NO. : 10/661053
DATED : July 25, 2006
INVENTOR(S) : Abraham Wien et al.

It is certified that error appears in the above-identified patent and that said Letters Patent is hereby corrected as shown below:

On the title page Item [12] should read as follows:

Wien et al.

On the title page Item [75] should read as follows:

Abraham Wien, Miami, FL (US);
Ralph Velocci, Golden Beach, FL (US)

On the title page Item [73] should read as follows:

RVAW, INC, Miami, FL (US)

Signed and Sealed this

Seventh Day of October, 2008

JON W. DUDAS
*Director of the United States Patent and Trademark Office*